US007197971B2

(12) United States Patent
Trovinger

(10) Patent No.: US 7,197,971 B2
(45) Date of Patent: Apr. 3, 2007

(54) DEVICE FOR TRIMMING SHEET MATERIAL

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 311 days.

(21) Appl. No.: 10/621,438

(22) Filed: Jul. 18, 2003

(65) Prior Publication Data

US 2005/0011322 A1 Jan. 20, 2005

(51) Int. Cl.
*B26D 5/20* (2006.01)

(52) U.S. Cl. ..... 83/256; 83/249; 83/404.1; 83/436.1; 226/19

(58) Field of Classification Search ..... 83/35, 83/36, 249, 255, 256, 404, 404.1, 436.1–436.9, 83/614; 226/19, 109–110, 124, 156–167
See application file for complete search history.

(56) References Cited

U.S. PATENT DOCUMENTS

| | | | | |
|---|---|---|---|---|
| 4,053,150 | A | 10/1977 | Lane | |
| 4,221,373 | A | 9/1980 | Muller | |
| 4,484,501 | A | 11/1984 | Ramcke | |
| 4,575,296 | A | 3/1986 | Kockler et al. | |
| 4,595,187 | A | 6/1986 | Bober | |
| 4,693,150 | A | 9/1987 | Barclay et al. | |
| 4,795,071 | A | 1/1989 | Jacobs et al. | |
| 4,891,681 | A | 1/1990 | Fiske et al. | |
| 5,028,193 | A | 7/1991 | Misicka | |
| 5,087,163 | A | 2/1992 | Erdbories et al. | |
| 5,115,846 | A * | 5/1992 | Miller et al. | 144/246.1 |
| 5,219,159 | A * | 6/1993 | Malachowski et al. | 271/228 |
| 5,273,274 | A | 12/1993 | Thomson et al. | |
| 5,278,624 | A * | 1/1994 | Kamprath et al. | 399/395 |
| 5,346,350 | A | 9/1994 | Luhman et al. | |
| 5,377,965 | A | 1/1995 | Mandel et al. | |
| 5,397,106 | A * | 3/1995 | Hill | 270/58.34 |
| 5,452,920 | A | 9/1995 | Parker | |
| 5,465,213 | A | 11/1995 | Ross | |
| 5,586,479 | A * | 12/1996 | Roy et al. | 83/74 |
| 5,632,587 | A | 5/1997 | Coyette | |
| 5,662,318 | A | 9/1997 | Harada et al. | |
| 5,803,891 | A | 9/1998 | Haan et al. | |
| 5,882,004 | A | 3/1999 | Padget | |
| 5,988,628 | A | 11/1999 | Mori | |
| 6,099,225 | A | 8/2000 | Allen et al. | |
| 6,193,458 | B1 | 2/2001 | Marsh | |
| 6,315,282 | B2 | 11/2001 | Chua et al. | |
| 6,363,851 | B1 | 4/2002 | Gerhard et al. | |
| 6,405,625 | B1 | 6/2002 | Nomura et al. | |
| 2001/0048863 | A1 | 12/2001 | Bagrosky | |
| 2002/0056306 | A1 | 5/2002 | Cleave et al. | |

FOREIGN PATENT DOCUMENTS

| | | |
|---|---|---|
| EP | 0992365 A1 | 4/2000 |
| JP | 02198952 | 7/1990 |
| WO | WO 0018583 | 4/2000 |

* cited by examiner

OTHER PUBLICATIONS

Berger P.: "Investieren Mit Blick Auf Digitale Nischenprodukte" Deutscher Drucker, Verlagsgeselllschaft, Ostfildern, DE, vol. 34 No. 35. Sep. 17, 1998, p. W45, W48 XP000783486, Relevant claims 1 and 4.

*Primary Examiner*—Kenneth E. Peterson
*Assistant Examiner*—Carolyn Blake

(57) ABSTRACT

A sheet material trimming apparatus and method are described which are suitable for use in a booklet making system. An exemplary apparatus includes at least one cutter for trimming a first and a second edge of a sheet material in a first and a second direction, and a drive system for moving the sheet material in two perpendicular directions for trimming the first and second edges with the at least one cutter. The drive system moves the sheet material in two perpendicular directions by rotating and translating a roller. The sheet material trimming apparatus allows for automatic changes in the amount of material cut off each side of the sheet material by moving the sheet material in two directions without requiring repositioning of the cutter(s).

21 Claims, 5 Drawing Sheets

PRIOR ART

DEVICE FOR TRIMMING SHEET MATERIAL

BACKGROUND INFORMATION

A system for finishing printed sheets into booklets is described in PCT Document No. WO 00/18583 (hereafter referred to as "the Trovinger PCT"), hereby incorporated by reference in its entirety. The Trovinger PCT includes an operation where individual booklet sheets are trimmed using a linear blade and a rotary blade which rotates against the linear blade. The sheets in the Trovinger PCT are each trimmed to a predetermined length depending on the thickness of the paper and the location of the sheet in the booklet. The differing lengths of each sheet in the booklet address the effect of the outer sheets wrapping over the inner ones.

In some cases it may be desirable to trim sheets in two perpendicular directions for formation of a booklet. For example, the trimming of four edges is useful to achieve "full bleed" printing for a marginless image. Four sided trimming devices have their cutting modules manually repositioned to change the amount of trimming on each edge if a different finished document size is needed.

SUMMARY

According to an exemplary embodiment, a sheet material trimming apparatus comprises a first cutter arranged to trim an edge of a sheet material in a first direction, a second cutter arranged to trim an edge of the sheet material in a second direction different from the first direction, and a drive system having a drive roller for advancing the sheet material in the first direction by rotation of the drive roller and for translating the sheet material in the second direction by translation of the drive roller.

According to an exemplary embodiment, an apparatus for trimming sheet material comprises cutting means for trimming a first edge and a second edge of a sheet material in a first direction and in a second direction, and drive means for moving the sheet material in two perpendicular directions for trimming the first and second edges with the cutting means, the drive means moving the sheet material in two perpendicular directions by rotating and translating a roller.

An exemplary method for trimming sheet material includes feeding a sheet material into a trimming mechanism, advancing the sheet material in a first direction to a first trimming position by rotation of a drive roller, trimming a first side of the sheet material, translating the sheet material in a second direction to a second trimming position by translation of the drive roller, and trimming a second side of the sheet material.

An exemplary booklet making system comprises a drive system for advancing sheet material in a first direction; and a sheet material trimming apparatus for receiving the sheet material advanced by the drive system, the sheet material trimming apparatus including a first cutter arranged to trim an edge of a sheet material in a first direction and a second cutter arranged to trim an edge of the sheet material in a second direction different from the first direction, and wherein the drive system is configured to translate the sheet material in a second direction by translation of the drive roller.

BRIEF DESCRIPTION OF THE DRAWINGS

Other objects and advantages will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1:
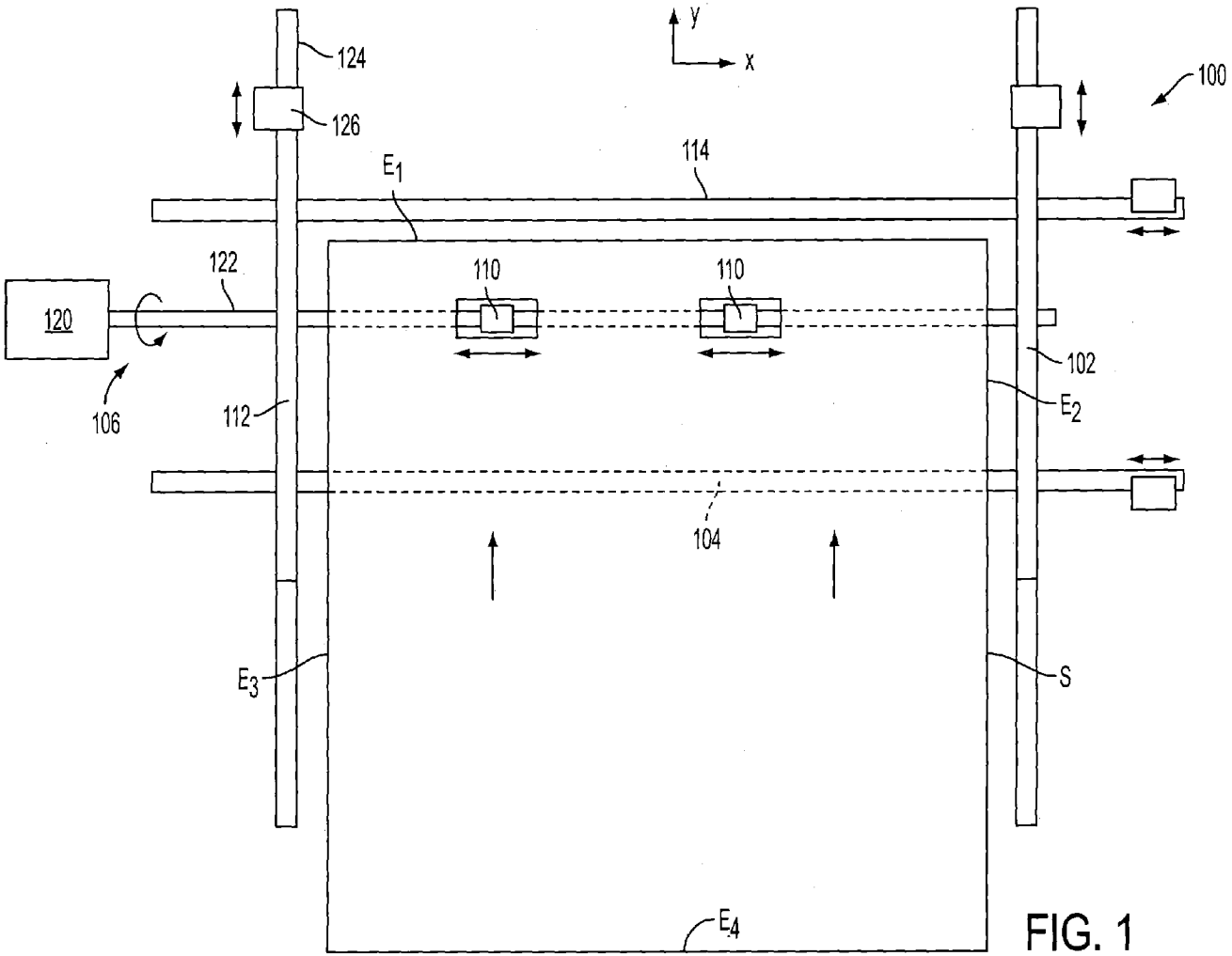
FIG. 1 is a schematic top view of an exemplary sheet trimming system.

An exemplary booklet making system having an apparatus for trimming sheet material is represented as system 100 in FIG. 1. System 100 allows for automatic changes in the amount of material cut off each side of sheet material by moving the sheet material in two or more directions. Different paper sizes can be achieved automatically, with the apparatus able to change finished sizes with every sheet if desired.

The sheet material trimming apparatus includes a cutting means for trimming a first edge and a second edge of a sheet material. For example, a cutting means includes a first cutter 102 arranged to trim a sheet material S in a first (e.g., Y) direction, and a second cutter 104 arranged to trim an edge of the sheet material in a second (e.g., X) direction.

Sheet material S is positioned for trimming in the X and Y directions by a drive means, such as the drive system 106. Drive system 106 can have one or more drive rollers 110 for advancing the sheet material S in the Y direction for trimming of the leading and trailing edges by rotation of the drive rollers and for translating the sheet material in the X direction for trimming of the side edges by translation of the drive rollers.

The apparatus for trimming sheet material can be incorporated in a sheetwise booklet maker for assembling plural sheets into a bound stack representing a booklet. The booklet maker can include additional features for folding, and binding the trimmed sheet material into a booklet. One example of a sheetwise booklet maker is described in the Trovinger PCT Document No. WO 00/18583. The Trovinger PCT describes an operation where individual booklet sheets are trimmed using a linear blade and a rotary blade which rotates against the linear blade. The Trovinger PCT describes that the sheets are each trimmed to a predetermined length depending on the thickness of the paper and the location of the sheet in the booklet. The differing lengths of each sheet in the booklet address the effect of the outer sheets wrapping over the inner ones.

The ability to both advance and translate sheet material S with the FIG. 1 drive system 106 for trimming edges of the sheet material allows the booklet maker system to trim any number of edges (e.g., two or more edges of a sheet) to create different size sheets without repositioning the cutters. Afterwards, the trimmed sheets can be optionally folded and bound using any known folder device and binding device, including that described in the Trovinger PCT, to form an assembled booklet.

For example, the trimmed sheets can be folded sheet-by-sheet using a V-shaped fold roller and elongated fold blade. The sheets can be collected into a stack for subsequent binding into a booklet using a stapler. More particularly, sheets (e.g., duplex printed sheets can be fed sheet-by-sheet using an automatic sheet feeder into a paper drive assembly that measures the width of each sheet. Such a paper drive assembly can be the drive of the FIG. 1 booklet maker, and can include the FIG. 1 trimming apparatus. The sheets are trimmed and advanced to a fold mechanism for subsequent folding, sheet-by-sheet, along their center line. Sheets removed from the fold mechanism can be stacked in registration on an inverted V-shaped workpiece and stapled to form an assembled saddle stitched booklet.

The FIG. 1 system can reposition sheet material in two directions with a set of drive rollers 110 which are able to both rotate and translate. Drive system 106 includes a motor 120 connected to a drive shaft 122 which rotates and translates the drive rollers 110 to move the sheet material in two substantially perpendicular directions (e.g., 90°±30°), or in any desired direction. An upper idler roller can be associated with (that is, opposed to) each of the drive rollers 110 if desired.

FIG. 1 illustrates a sheet material trimming apparatus having a third cutter 112 parallel to the first cutter 102 and arranged to cut an opposite side of the sheet material from the first cutter. A fourth cutter 114 is parallel to the second cutter 104 and arranged to cut a leading edge of the sheet material opposite from the second cutter. Those skilled in the art will appreciate that any number of cutters oriented as desired can be included.

In operation, the FIG. 1 system can be used to perform a method for trimming sheet material. An exemplary method includes feeding sheet material S in a Y direction into a trimming mechanism represented as the FIG. 1 trimming apparatus using precision paper drive rollers 110 which can be formed as part of the sheet trimming apparatus, or which can be formed separately from the sheet trimming apparatus. Edges of sheet material S (e.g., the four peripheral edges) are then trimmed with cutters, such as the cutters 102, 104, 112, 114. An order of trimming of the edges can be adjusted depending on the application or can be randomly selected in accordance with any desired trim schedule.

According to one example, sheet material S is advanced in a first direction to a first trimming position for trimming a first side, by rotation of a drive roller. For example, rotation of rollers 110 advances sheet material S until a leading edge $E_1$ is positioned at a predetermined position for trimming a side of the sheet material with fourth cutter 114. Sheet material S is then translated in a second direction to a second trimming position by translation of a drive roller. For example, sheet material S is translated in the positive X direction by translation of the rollers 110 until a second side edge $E_2$ is at a trimming position (e.g., a predetermined position) for trimming with first cutter 102. This translation can be followed by translation in the negative X direction until an opposite side edge $E_3$ is positioned for trimming with third cutter 112. Sheet materials can then be advanced by rotation of drive rollers 110 until a trailing edge $E_4$ is positioned at a trimming position (e.g., a predetermined position) for trimming by second cutter 104.

Figure 3:
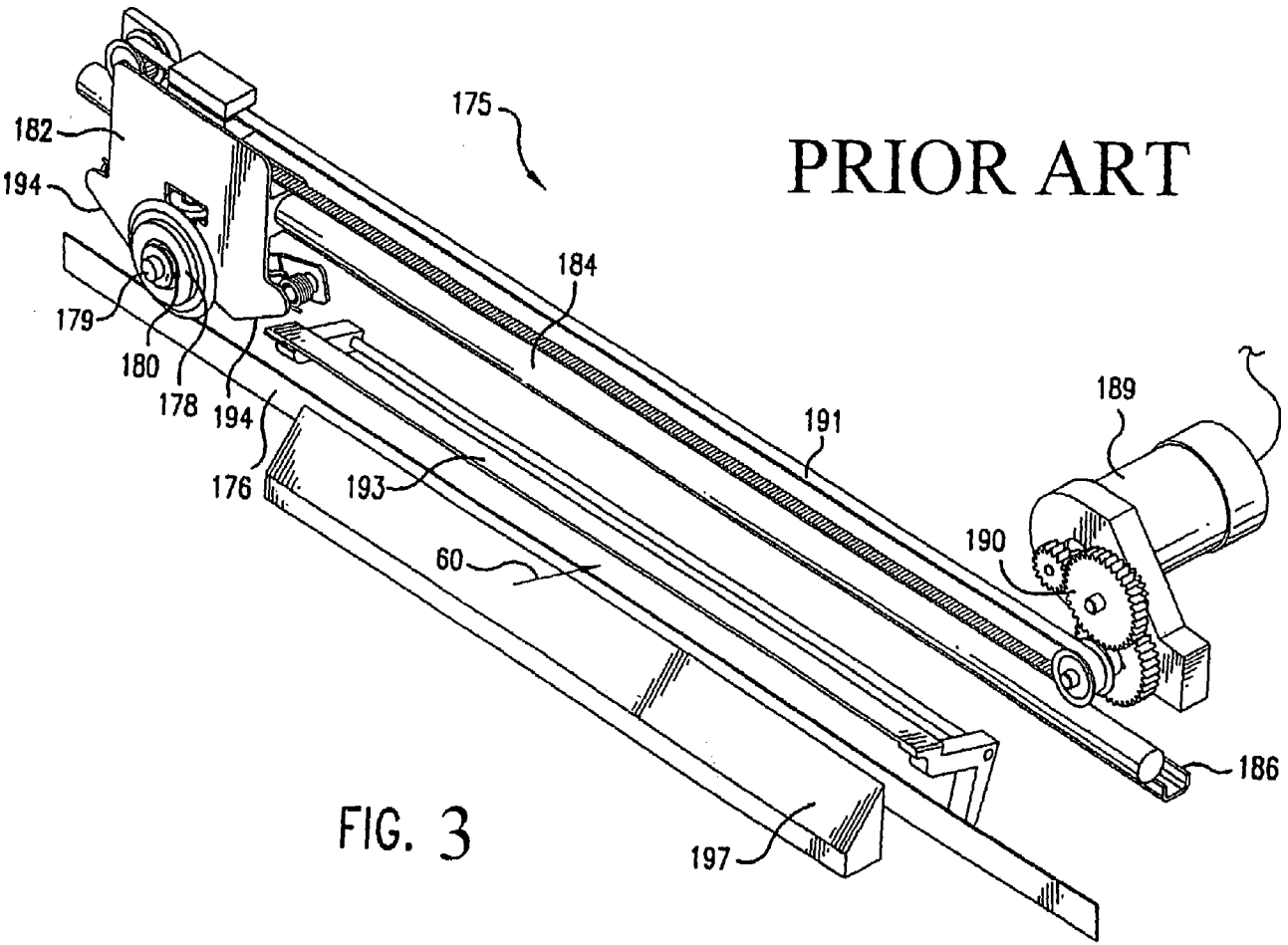
FIG. 3 shows an exemplary cutter and cutter bail system that can be used in the exemplary FIG. 1 embodiment.

Cutters 102, 104, 112, 114 can be low cost rotary, linear cutters, such as those used in large format printers and plotters or any other suitable cutter. According to another embodiment, the cutters can be those described in the Trovinger PCT document No. WO 00/18583, wherein a cutter is configured as a linear blade formed of hardened steel as a flat straight edge that is parallel with a line of pinch points of grit wheels and pinch wheels of a paper drive assembly. FIG. 3 shows an individual cutter 175 from the Trovinger PCT wherein a linear blade 176 is shown. A cooperating rotary blade 178, also fabricated from hardened steel or other suitable material is round, self-sharpening, and tapered from its periphery. The rotary blade rotates freely about an axle 179, and is spring biased by spring 180 against an upper edge of the linear blade, with the axle positioned so that the rotary blade contacts the linear blade at only two points. Sheets are cut in scissor-like manner by crushing paper between the rotary blade 178 and the linear blade 176. An angle of attack of the rotary blade and the linear blade (for example, 15 degrees relative to horizontal) can be selected such that sheets are not forced out of the interface between the two blades and sheets are cut with minimum force. The rotary blade is supported by a blade holder 182 capable of a transverse motion across a paper path 60 controlled by a main slider rod 184. A stationary guide channel 186 can be mounted to cooperate with an associated guide block mounted on blade holder 182. A drive motor 189 drives rotary blade 178 transversely using gear train 190 and drive belt 191.

The Trovinger PCT describes use of a cutter bail 193 to clamp a sheet in place during cutting. The blade holder 182 has two included, opposed ramps 194 to accommodate bidirectional cutting. The bail can be pressed downward by bail rollers mounted on the blade holder 182 on either side of rotary blade 178 and axle 179. A vertical ramp 197 can be used to deflect trimmed sheets away from the cutter 175.

A bail system as described in the Trovinger PCT can be used in combination with any or each of the FIG. 1 cutters to clamp the sheet during cutting. As shown in FIG. 1, cutters 102, 104, 112, 114, can each include a slider support 124 and a rotary cutter 126 movable along the slider support in a manner similar to that described with respect to FIG. 3.

Figure 2A:
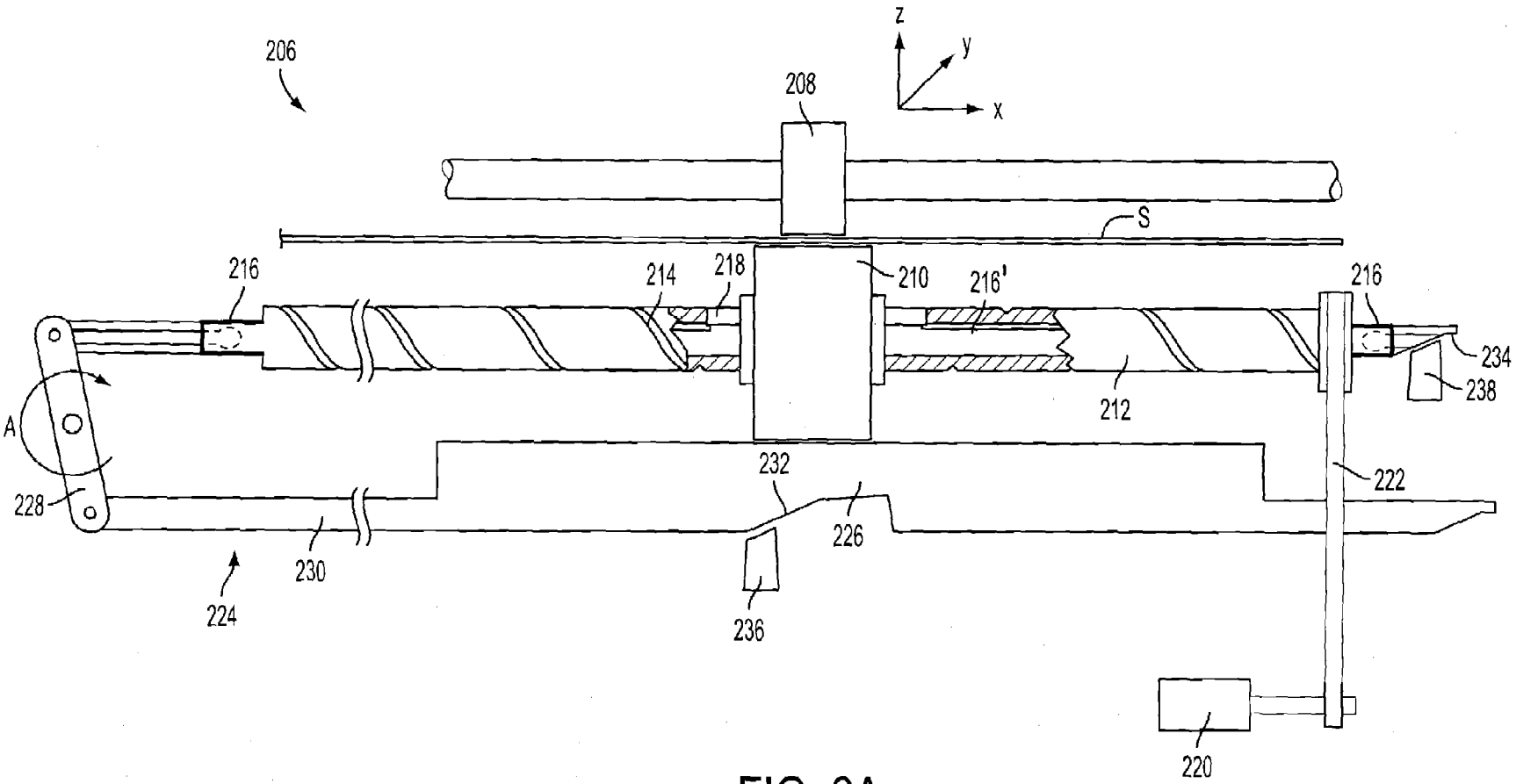
FIG. 2A is a perspective view of an exemplary drive system for the sheet trimming system of FIG. 1.

FIG. 2A illustrates one example of a drive system 206 for advancing and translating sheet material S. The drive system 206 includes a drive roller 210 mounted on an outer drive shaft 212 and an idler roller 208 mounted to oppose (e.g., above) the drive roller. Those skilled in the art will appreciate that any number of drive rollers can be used. Rotation of outer drive shaft 212 acts to both rotate and translate drive roller 210. Outer drive shaft 212 has an external thread 214 and is mounted for rotation by two rotatable couplings 216. Outer drive shaft 212 is rotated by a drive mechanism, such as a motor 220 and a belt 222. Motor 220 and appropriate sensors can function to precisely reposition sheet material S in the X and Y directions.

Figure 2B:
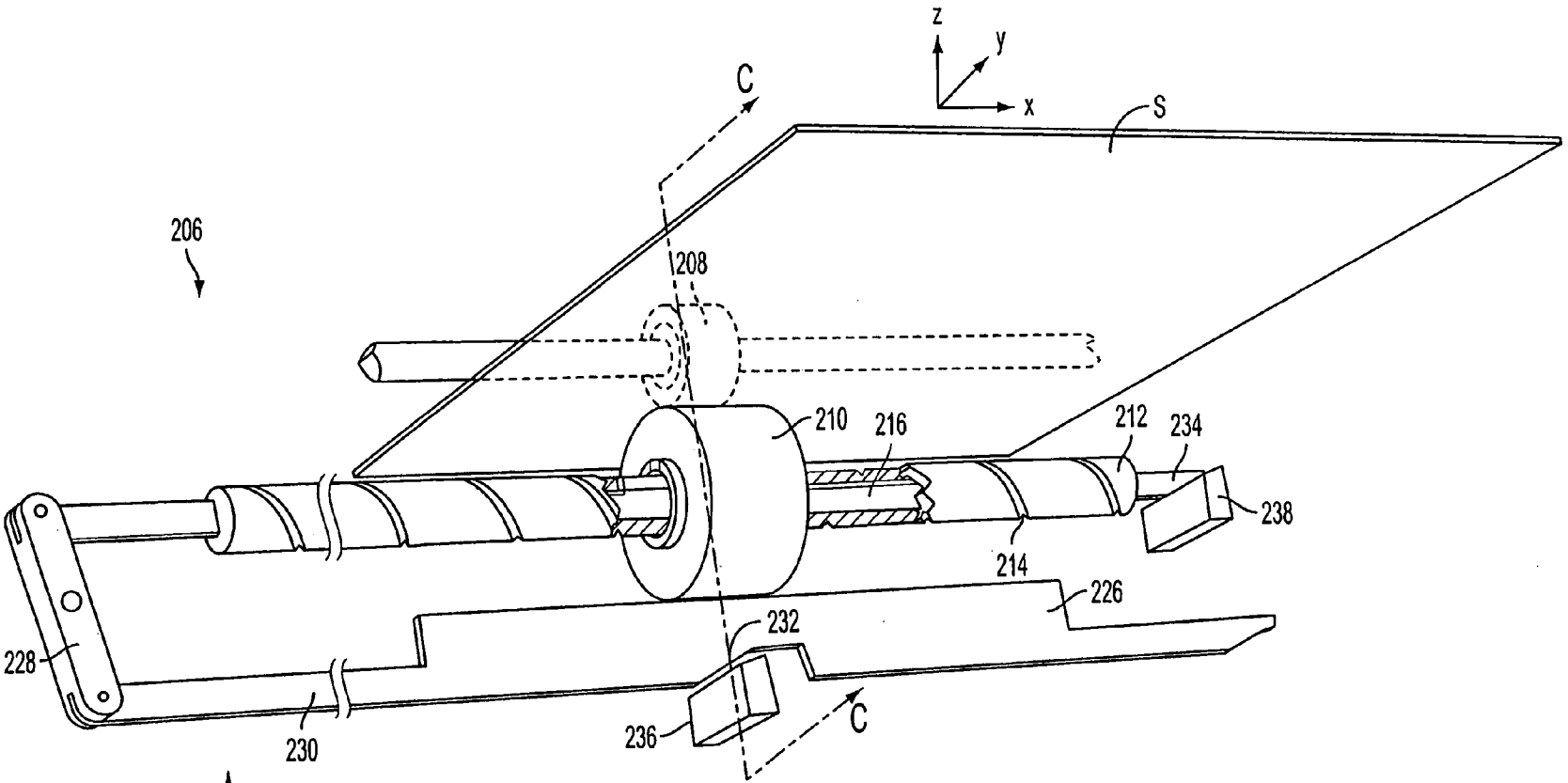
FIG. 2B is a bottom perspective view of the drive system of FIG. 2A.
Figure 2C:
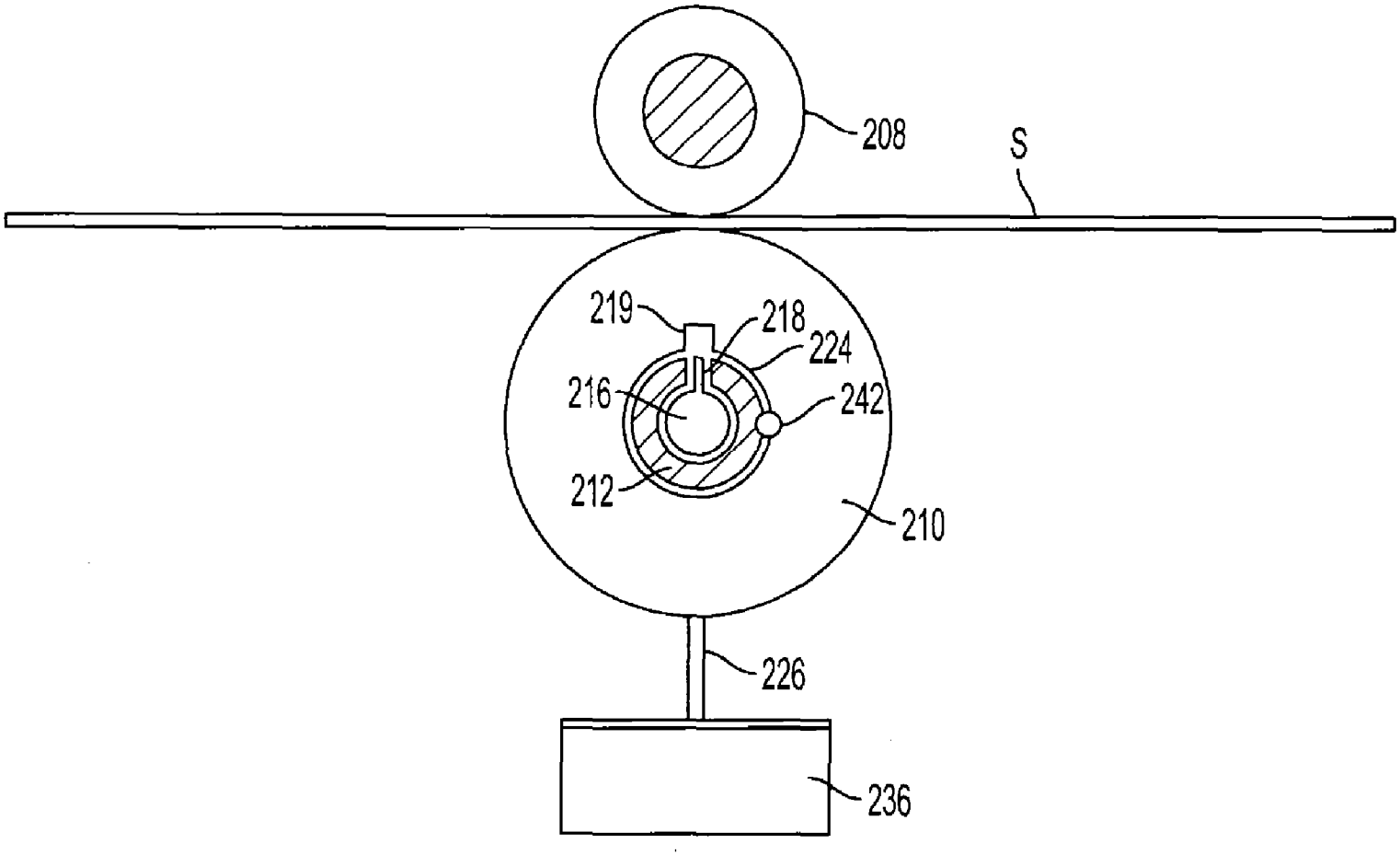
FIG. 2C is a cross sectional view taken along line C—C of FIG. 2B.

Drive system 206 also includes an inner drive shaft 216' with a locking tab 218 of an engage means, shown in FIG. 2C, for locking drive roller 210. Locking tab 218 is movable into a slot 219 in drive roller 210 to lock the drive roller to drive shaft 212 for advancing sheet material S.

In the embodiment of FIG. 2A, the engage means, includes an exemplary engage mechanism 224, to prevent rotation of drive roller 210 when sheet material S is translated. Engage mechanism 224 functions to engage and disengage a stop means, represented as a stopper 226, from drive roller 210. Engage mechanism 224 has a first position at which rotation of drive shaft 212 causes drive roller 210 to rotate with the drive shaft, (that is, the drive roller can be fixed to the drive shaft by locking tab 218), and a second position (shown in FIG. 2A) at which rotation of the drive shaft causes the drive roller to translate on the drive shaft, (that is, the drive roller can be prevented from rotating by stopper 226).

Engage mechanism 224 includes a rotating link 228 which can be activated by rotating the link in any known manner, such as by a motor or solenoid or other activation.

Engage mechanism 224 also includes an arm 230 having the stopper 226 on one side and a ramp 232 on another side. Another ramp 234 is connected to the drive shaft. Ramps 232, 234 ride on corresponding ramps 236, 238 to lift or lower portions of engage mechanism 224 in the Z direction during rotation of rotating link 228.

Engage mechanism 224 is illustrated in the second position in FIG. 2A with a surface of stopper 226 in contact with drive roller 210 to prevent rotation of the drive roller. In the second position shown, locking tab 218 of inner shaft 216 is disengaged from locking slot 219 in drive roller 210.

As shown in FIG. 2 FIGS. 2B and 2C, drive shaft 212 includes external thread 214 and drive roller 210 includes an internal thread engaging member, such as a spherical member 242. Spherical member 242 is fixed to the interior of drive roller 210 and slides in the external thread 214 of shaft 212 as the shaft rotates translating the drive roller along the shaft.

Engage mechanism 224 is rotatable from the second position, shown in FIGS. 2A, 2B, and 2C to the first position by rotation of link 228 in the direction of the arrow A in FIG. 2A. This rotation moves stopper 226 in the negative Z direction away from drive roller 210 by moving ramp 232 over corresponding ramp 236. This rotation also moves locking tab 218 of inner shaft 216 into the corresponding locking slot 219 in drive roller 210 by moving ramp 234 over corresponding ramp 238. When engage mechanism 224 is at the first position, drive roller 210 is locked to rotate with the shaft without translation of the drive roller to advance sheet material S in the Y direction. In this way, engage mechanism 224 operates to switch drive system 206 between rotation and translation of drive rollers 210.

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A sheet material trimming apparatus, comprising:

a first cutter arranged to trim an edge of a sheet material in a first direction;

a second cutter arranged to trim an edge of the sheet material in a second direction different from the first direction; and a drive system having a drive roller for advancing the sheet material in the first direction by rotation of the drive roller and for translating the sheet material in the second direction by translation of the drive roller, wherein the drive roller is mounted on a drive shaft, and wherein rotation and translation of the drive roller are directly caused by rotation of the drive shaft.

2. The apparatus of claim 1, wherein the first cutter includes a rotary blade movable in the first direction.

3. The apparatus of claim 1, wherein the second cutter includes a rotary blade movable in the second direction, and the second direction is perpendicular to the first direction.

4. The apparatus of claim 1, comprising a third cutter arranged parallel to the first cutter, the first and third cutters arranged to trim opposite sides of the sheet material.

5. The apparatus of claim 4, comprising a fourth cutter parallel to the second cutter, the second and fourth cutters arranged to trim opposite sides of the sheet material.

6. The apparatus of claim 1, comprising an engage mechanism having a first position and a second position, and wherein rotation of the drive shaft with the engage mechanism at the first position causes the drive roller to rotate, and rotation of the drive shaft with the engage mechanism at the second position causes the drive roller to translate.

7. The apparatus of claim 6, comprising a stopper which prevents rotation of the drive roller when the engage mechanism is in the second position.

8. The apparatus of claim 6, comprising a lock which locks the drive roller to the drive shaft when the engage mechanism is in the first position.

9. The apparatus of claim 6, wherein the engage mechanism is rotatable from the first position to the second position.

10. The apparatus of claim 1, wherein the drive shaft includes an external thread and the drive roller includes and internal thread engaging member which slides in the external thread.

11. An apparatus for trimming sheet material, comprising:

cutting means for trimming a first edge and a second edge of a sheet material in a first direction and a second direction; and drive means for moving the sheet material in two perpendicular directions for trimming the first and second edges with the cutting means, the drive means moving the sheet material in two perpendicular directions by rotating and translating a roller, wherein the roller is mounted on a threaded drive shaft, and wherein rotation and translation of the drive roller are directly caused by rotation of the drive shaft.

12. The apparatus of claim 11, comprising an engage mechanism having a first position and a second position, and wherein rotation of the drive shaft with the engage mechanism at the first position causes the drive roller to rotate, and rotation of the drive shaft with the engage mechanism at the second position causes the drive roller to translate.

13. The apparatus of claim 12, comprising stop means for preventing rotation of the drive roller when the roller is translating.

14. The apparatus of claim 12, comprising lock means for locking the drive roller to the draft shaft when the engage mechanism is at the first position.

15. The apparatus of claim 11, wherein the cutting means includes first and second perpendicular cutters.

16. A booklet making system for assembling plural sheets into a bound stack, comprising:

a drive system for advancing sheet material in a first direction by rotation of a drive roller and for translating the sheet material in a second direction different from the first direction by translation of the drive roller, wherein the drive roller is mounted on a drive shaft, and wherein rotation and translation of the drive roller are directly caused by rotation of the drive shaft;

a sheet material trimming apparatus for receiving the sheet material advanced by the drive system, the sheet material trimming apparatus including a first cutter arranged to trim an edge of a sheet material in the first direction; and a second cutter arranged to trim an edge of the sheet material in the second direction.

17. The system of claim 16, wherein the first cutter includes a rotary blade movable in the first direction.

18. The system of claim 16, wherein the second cutter includes a rotary blade movable in the second direction, and the second direction is perpendicular to the first direction.

19. The system of claim 16, comprising a third cutter arranged parallel to the first cutter, the first and third cutters arranged to trim opposite sides of the sheet material.

20. The system of claim 19, comprising a fourth cutter parallel to the second cutter, the second and fourth cutters arranged to trim opposite sides of the sheet material.

21. The system of claim 16, comprising an engage mechanism having a first position and a second position, and wherein rotation of the drive shaft with the engage mechanism at the first position causes the drive roller to rotate, and rotation of the drive shaft with the engage mechanism at the second position causes the drive roller to translate.

* * * * *